US006298919B1

(12) United States Patent
Browne et al.

(10) Patent No.: US 6,298,919 B1
(45) Date of Patent: Oct. 9, 2001

(54) DOWNHOLE HYDRAULIC PATH SELECTION

(75) Inventors: Paul L. Browne, Stavanger (NO); Clark E. Robison, Plano, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/260,601

(22) Filed: Mar. 2, 1999

(51) Int. Cl.[7] ..... E21B 34/14

(52) U.S. Cl. ..... 166/373; 166/332.4; 166/332.5; 166/386

(58) Field of Search ..... 166/72, 102, 332.4, 166/332.5, 332.1, 319, 321, 242.1, 386, 373

(56) References Cited

U.S. PATENT DOCUMENTS

| | | | | |
|---|---|---|---|---|
| 3,503,445 | * | 3/1970 | Cochrum et al. | 166/244 |
| 3,786,863 | * | 1/1974 | Tausch | 166/72 |
| 4,249,599 | * | 2/1981 | Krause | 166/72 |
| 4,252,196 | | 2/1981 | Silverman et al. . | |
| 4,273,186 | * | 6/1981 | Pearce et al. | 166/72 |
| 4,434,847 | * | 3/1984 | Vazquez et al. | 166/177.5 |
| 4,480,687 | * | 11/1984 | Terral | 166/117.5 |
| 4,540,047 | * | 9/1985 | Akkerman | 166/188 |
| 4,660,647 | * | 4/1987 | Richart | 166/386 |
| 5,156,207 | | 10/1992 | Haugen et al. . | |
| 5,183,114 | | 2/1993 | Mashaw, Jr. et al. . | |
| 5,193,615 | * | 3/1993 | Akkerman | 166/129 |
| 5,211,241 | | 5/1993 | Mashaw, Jr. et al. . | |

FOREIGN PATENT DOCUMENTS

| | | |
|---|---|---|
| WO 97/06344 A | 2/1997 | (WO) . |
| WO 98/09055 A | 3/1998 | (WO) . |
| WO 98/55731 A | 12/1998 | (WO) . |

OTHER PUBLICATIONS

Otis Through–Flowline (TFL) Completion Equipment Catalog pp. 239–250, undated.
European Search Report for application No.: EP00/301258.

* cited by examiner

*Primary Examiner*—Hoang Dang
(74) *Attorney, Agent, or Firm*—William M. Imwalle; Marlin R. Smith

(57) ABSTRACT

A method of servicing a well and an associated well system provide convenient downhole hydraulic path selection. In a described embodiment, a hydraulic path selector is preconfigured for selection of a desired hydraulic path set, and then the selector is conveyed into a tubular string in which a hydraulic manifold is connected to one or more hydraulically operable tools. When engaged with the manifold, the selector selects the appropriate hydraulic path set, which selection determines which tool is to be operated and/or in what manner the tool is to be operated. In another described embodiment, the selector is operated after engagement with the manifold to select the appropriate path set.

20 Claims, 12 Drawing Sheets

DOWNHOLE HYDRAULIC PATH SELECTION

BACKGROUND OF THE INVENTION

The present invention relates generally to operations performed in conjunction with subterranean wells and, in an embodiment described herein, more particularly provides a method and system for downhole selection of hydraulic paths for operation of tools.

A need exists for reducing the expense, and correspondingly increasing the speed and convenience, of operating tools, such as flow control devices, in a well. For example, for a producing well, it is somewhat costly to rig up a slickline or wireline unit at the well in order to adjust a downhole choke, or to open or close a valve downhole. It would be far less costly to be able to make such adjustments by applying fluid pressure at the earth's surface in order to cause an adjustment of a choke, opening or closing of a valve, etc.

It is, of course, well known to extend control lines from downhole tools to the earth's surface, so that the tools may be operated by applying fluid pressure to one or more of the lines to operate selected ones of the tools. Unfortunately, where there are multiple such tools, it quickly becomes cumbersome, time-consuming and expensive to install the control lines. Additionally, where a tool is positioned relatively deep in a well, the expense of the lines increases dramatically, as does the probability that the lines will become damaged during installation or thereafter.

One method of performing well servicing operations without the need of rigging up a slickline or wireline unit is provided by the TFL ("through flowline") system developed by Otis and now available from Halliburton Energy Services, Inc. In this system, various items of equipment are circulated into a well through one or more flowlines, which may be production tubing strings. The equipment, once delivered into a well, is capable of performing a variety of operations, such as making adjustments to flow control tools, paraffin cutting, etc. However, although the TFL system does provide a means of operating a mechanically operable tool by application of fluid pressure to certain TFL equipment, it does not at present provide a means for selecting a hydraulically operable tool for actuation thereof.

From the foregoing, it can be seen that it would be quite desirable to provide a well system and method of operating downhole hydraulically operable tools, and specifically of selecting such tools for operation thereof. The method should not require the use of control lines extending large distances. Additionally, the method should not require the use of a slickline or wireline rig, although embodiments of the method may permit such use of a slickline or wireline rig. For use in highly deviated wells, or in other circumstances, the method may also permit use of a coiled tubing rig to perform the tool selection, deliver fluid or fluid pressure, etc.

SUMMARY OF THE INVENTION

In carrying out the principles of the present invention, in accordance with an embodiment thereof, a method of servicing a well is provided in which a hydraulic path selector is conveyed into a tubular string in order to select a desired hydraulically operable tool for operation thereof. Associated well systems are provided as well.

In one aspect of the present invention, a method of servicing a well includes the steps of interconnecting a hydraulic manifold and one or more hydraulically operable tools in a tubing string. The hydraulic manifold and tools are connected via hydraulic. paths, which may be lines extending external to the tubing string. When it is desired to operate one or more of the tools, a hydraulic path selector is conveyed into the tubing string and engaged within the manifold. The selector selects one or more of the hydraulic paths for application of fluid pressure thereto in order to operate the desired tool(s).

In another aspect of the present invention, the selector may be conveyed by circulating it into the manifold in the tubing string, by conveying it suspended from a wireline or slickline, or by attaching it to a fluid conduit, such as coiled tubing. Where the conveyance is a fluid conduit, fluid and fluid pressure may be delivered via the conduit to operate the selected tool.

In yet another aspect of the present invention, the selector may be preconfigured before it is conveyed into the manifold, so that, when the selector is engaged with the manifold, the desired tool is automatically selected for operation thereof. Alternatively, the selector may be manipulated downhole to select the desired tool.

In still another aspect of the present invention, the selector may include, or have attached thereto, features which cause or enable operation of the selected tool. For example, as mentioned above, a fluid conduit attached to the selector may be a source of fluid and/or fluid power to operate the tool. A self contained fluid power source may be attached to the selector. A known volume of fluid may be conveyed with the selector in order to cause a desired operation of the selected tool. An uncontaminated volume of fluid may be conveyed with the selector, so that the selected tool is operated using clean fluid, or a fluid with desired properties.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1:
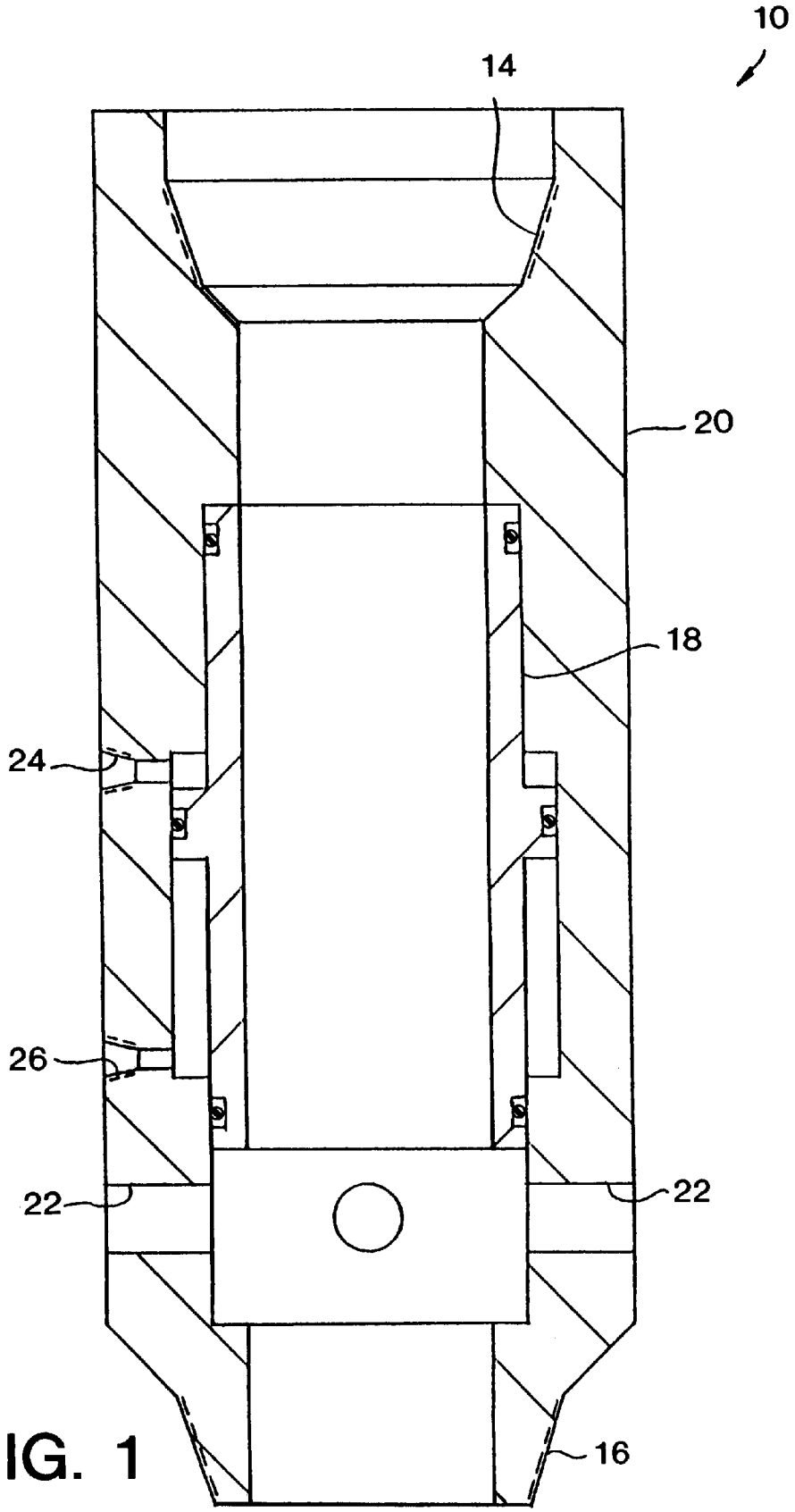
FIG. 1 is a cross-sectional view of a first tool operable by methods embodying principles of the present invention.
Figure 2:
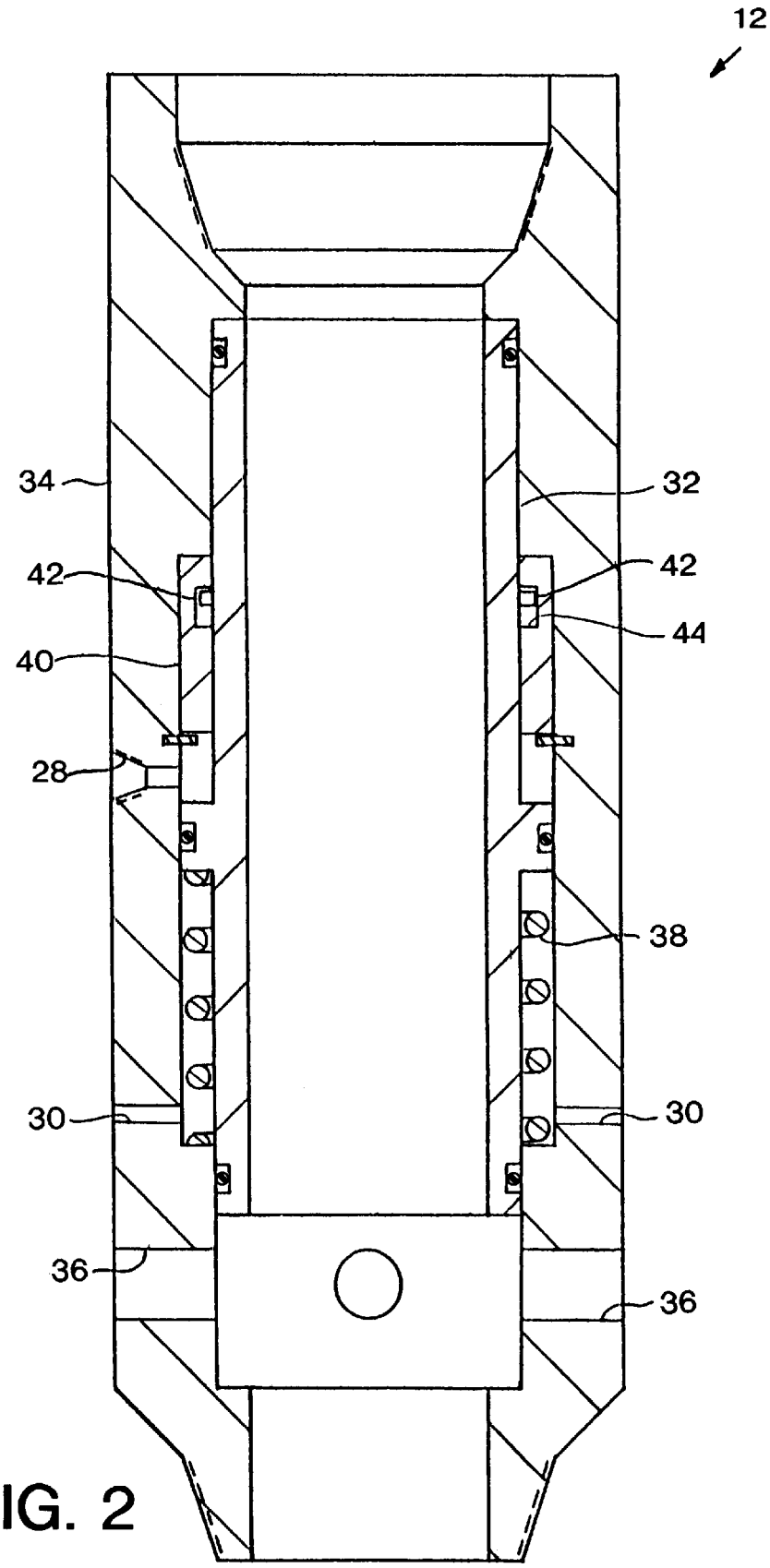
FIG. 2 is a cross-sectional view of a second tool operable by methods embodying principles of the present invention.

Representatively illustrated in FIGS. 1 & 2 are examples of hydraulically operable tools 10, 12 which are usable in methods and systems embodying principles of the present invention. In the following description of the tools 10, 12 and other apparatus, systems and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

Referring initially to FIG. 1, the tool 10 depicted therein is a flow control device of the type used to regulate fluid flow through a sidewall thereof. The tool 10 is provided with threaded end connections 14, 16 for facilitating interconnection of the tool in a tubular string, such as a production tubing string. Thus, the tool 10 may be used in a producing well for regulating the flow of fluid into a production tubing string. However, it is to be clearly understood that the tool 10 may be used in other applications, such as in an injection well or in a work string, etc., without departing from the principles of the present invention.

For regulating the flow of fluid through its sidewall, the tool 10 includes a sleeve 18 axially reciprocably and sealingly disposed within a generally tubular housing 20. Openings 22 provide passages for the fluid to flow through the housing 20. When the sleeve 18 is upwardly disposed in the housing 20 as depicted in FIG. 1, the openings 22 are fully open, permitting a maximum fluid flow rate therethrough. However, when the sleeve 18 is shifted downwardly in the housing 20, the sleeve will partially or completely obstruct the openings 22, thereby decreasing or completely stopping the fluid flow through the openings.

The sleeve 18 is displaced relative to the housing 20 by application of fluid pressure to one or both of two ports 24, 26. It will be readily appreciated by one skilled in the art that the sealing engagement between the sleeve 18 and the housing 20 provides a piston area which may be used, in conjunction with a fluid pressure differential thereacross, to apply a force to the sleeve in order to displace the sleeve relative to the housing. Thus, it may be seen that a fluid pressure applied to the port 24, which is greater than fluid pressure applied to the port 26, will cause a downwardly biasing force to be applied to the piston area on the sleeve 18, thereby permitting the sleeve to be displaced downwardly. Conversely, a fluid pressure applied to the port 26, which is greater than fluid pressure applied to the port 24, will cause an upwardly biasing force to be applied to the piston area on the sleeve 18, thereby permitting the sleeve to be displaced upwardly.

Referring additionally now to FIG. 2, the tool 12 depicted therein is a type of flow control device which may also be interconnected in a tubing string to regulate the flow of fluid into, or out of, the tubing string through a sidewall thereof. The tool 12 differs from the tool 10 described above, however, in at least one significant respect, in that only a single port 28 is used to apply fluid pressure in order to operate the tool 12. In addition, apertures 30 admit fluid pressure from the well surrounding the tool 12 when it is installed therein.

As depicted in FIG. 2, an inner sleeve 32 is sealingly and reciprocably disposed in a generally tubular housing 34, which has openings 36 formed through a sidewall thereof. The sleeve 32 is shown in its upwardly disposed position relative to the housing 34, with the openings 36 being fully open to fluid flow therethrough. When the sleeve 32 is downwardly shifted, the sleeve partially or completely blocks the openings 36, thereby regulating the rate of fluid flow therethrough, or completely preventing fluid flow through the openings.

To downwardly displace the sleeve 32 relative to the housing 34, fluid pressure is applied to the port 28, which pressure is greater than fluid pressure in the well external to the tool 12. It will be readily appreciated that the sealing engagement between the sleeve 32 and housing 34 provides a piston area which, in conjunction with the differential between pressure applied to the port 28 and pressure admitted through the apertures 30, will cause a downwardly biasing force to be applied to the sleeve. When this downwardly biasing force is greater than an upwardly biasing force exerted on the sleeve 32 by a biasing member or spring 38, the sleeve displaces downwardly. However, in general, the spring 38 will upwardly displace the sleeve 32 when the sleeve is downwardly disposed from its position as depicted in FIG. 2 and the pressure differential is not great enough to overcome the spring's upwardly biasing force.

Displacement of the sleeve 32 relative to the housing 34 is further controlled by a J-slot or ratchet member 40 rotatably disposed within the housing and engaged with the sleeve via projections 42 extending outwardly from the sleeve. The projections 42 are engaged with a recessed path 44 formed internally on the ratchet member 40. Such ratchet mechanisms, in which the displacement of one element relative to another element of an assembly are limited or controlled by a path formed on a ratchet member, are well known to those skilled in the art. For example, the ratchet path 44 may be configured to require only a single, or a series of, initial fluid pressure applications to the port 28 before the sleeve 32 is permitted to displace fully downward to close off the openings 36. As another example, the ratchet path 44 may be configured so that each pressure application to the port 28 causes the sleeve 32 to displace incrementally downward and then upward, so that fluid flow through the openings 36 may be correspondingly incrementally decreased and then increased. These and many other configurations of the ratchet path 44 may be utilized in the tool 12.

Figure 3:
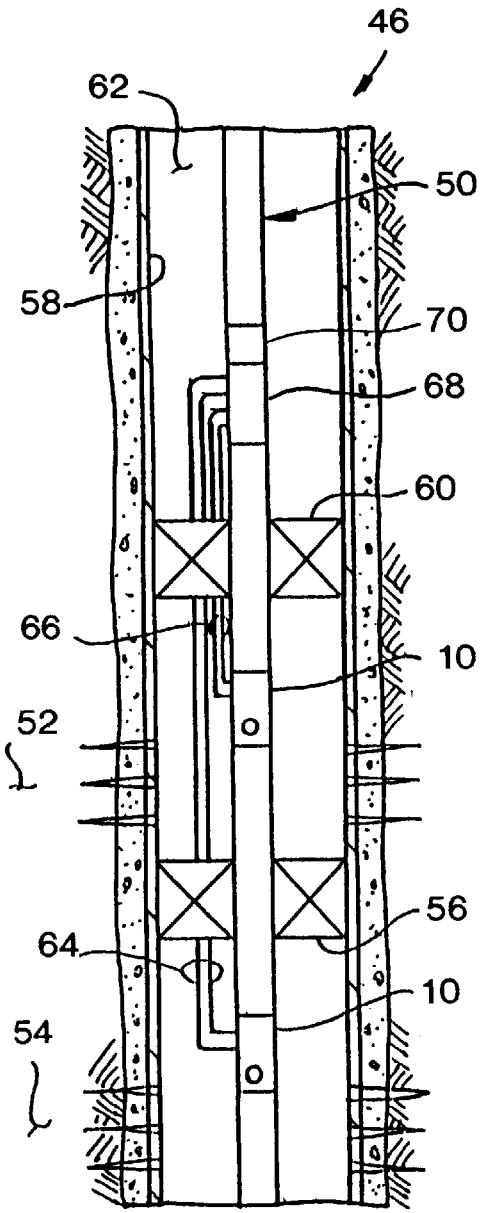
FIG. 3 is a schematic view of a first well servicing method and system embodying principles of the present invention.
Figure 4:
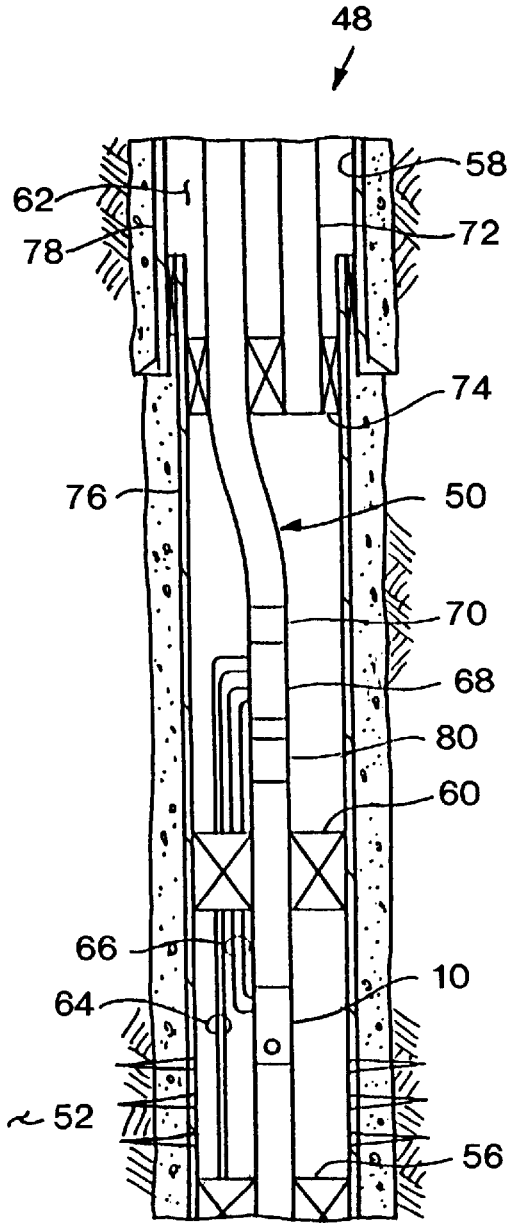
FIG. 4 is a schematic view of a second well servicing method and system embodying principles of the present invention.

Referring additionally now to FIGS. 3 & 4, methods 46, 48 of servicing a well are representatively and schematically illustrated, the methods embodying principles of the present invention. As depicted in the drawing figures, the methods 46, 48 utilize the tool 10 described above, but it is to be clearly understood that other tools, such as the tool 12 described above, other flow control devices, such as flow chokes, and other types of hydraulically operable tools may be utilized in the methods 46, 48, and in other methods embodying principles of the present invention.

Referring initially to FIG. 3, the method 46 utilizes two of the tools 10 interconnected in a tubing string 50 installed in the well. The tools 10 are used to regulate fluid flow into the tubing string 50 from two zones 52, 54 intersected by the well. A lower packer 56 isolates the zones 52, 54 from each other in a wellbore 58 of the well, and an upper packer 60 isolates the zones from an annulus 62 formed between the tubing string 50 and the wellbore 58 extending to the earth's surface.

Each tool 10 is operated by applying fluid pressure to one or more lines included in sets of lines 64, 66 connected to the ports 24, 26 of the tools. As depicted in FIG. 3, each set of lines 64, 66 includes two such lines for operation of its respective tool 10. However, it will be readily appreciated that greater or fewer numbers of lines in one or both of the sets of lines 64, 66 may be utilized, for example, depending upon the type of tool to be operated. Thus, if a tool 12 is used in place of one of the tools 10 in the method 46, one of the sets of lines 64, 66 may include only a single line for operation of the tool 12.

The sets of lines 64, 66 provide hydraulic paths between the tools 10 and a hydraulic manifold 68 interconnected in the tubing string 50 above the upper packer 60. Of course, hydraulic paths may be provided by means other than lines extending external to the tubing string 50, for example, by fluid passages formed longitudinally in a sidewall of the tubing string between the manifold 68 and the tools 10, by lines extending internally through the tubing string, etc. Additionally, as depicted in FIG. 3, the sets of lines 64, 66 extend through one or both of the packers 56, 60, but it is to be understood that it is not necessary for the sets of lines to extend through packers, since the manifold 68 could be interconnected below the upper packer 60, a lower packer 56 may not be positioned between the tools 10, etc.

As described more fully below, the hydraulic manifold 68 eliminates the necessity for the sets of lines 64, 66 to extend to the earth's surface for operation of the tools 10. Instead, the manifold 68 provides a means of selecting from among the sets of lines 64, 66, so that applied fluid pressure is routed to the appropriate set of lines for operation of a selected one of the tools 10. This selection is performed downhole in part by engagement of a discriminator or selector (not shown in FIG. 3) with the manifold 68 as described below. For example, the discriminator or selector may be conveyed into the manifold 68 and positioned therein utilizing a conventional landing nipple 70 interconnected in the tubing string 50 above the manifold 68. The discriminator or selector may, upon engagement with the manifold 68 cause one of the lines of the set 66 to be in fluid communication with the tubing string 50 above the manifold, while another line of the set 66 is placed in fluid communication with the tubing string below the manifold. Fluid pressure may then be applied to the tubing string 50 at the earth's surface to cause the tool 10 to open, close, or otherwise regulate fluid flow therethrough.

Referring additionally now to FIG. 4, the method 48 is similar in many respects to the method 46 described above, but differs in at least one significant respect in that another tubing string 72 is utilized to provide an additional flowpath, and a dual string packer 74 is used to seal off the wellbore 58 above the packer 60. In addition, a liner 76 is utilized to line the wellbore 58 below a casing string 78, for its greater pressure withstanding capabilities.

In the method 48, a selector or discriminator is engaged with the manifold 68 to select one or more of the sets of lines 64, 66 for operation of one or both of the tools 10 as described above for the method 46. However, the additional flowpath provided by the tubing string 72 permits additional versatility in the method 48. For example, the additional flowpath provided by the tubing string 72 permits TFL techniques to be utilized to circulate the selector or discriminator to the manifold 68 through the tubing string 50, and to retrieve the selector from the tubing string, without the need of a conveyance, such as slickline, wireline, another tubing string, etc., and without the need of displacing fluid contained in the annulus 62 above the packer 74. For this purpose, a TFL circulation control valve 80 may be interconnected in the tubing string 50 below the manifold 68. As another example, the tubing string 72 may provide another fluid pressure source for operating the tools 10, so that, when the selector or discriminator is engaged in the manifold, one or more of the lines in the sets of lines 64, 66 may be in fluid communication with the tubing string 72, and fluid pressure applied to the tubing string may be used to operate the selected tool or tools.

Figure 5:
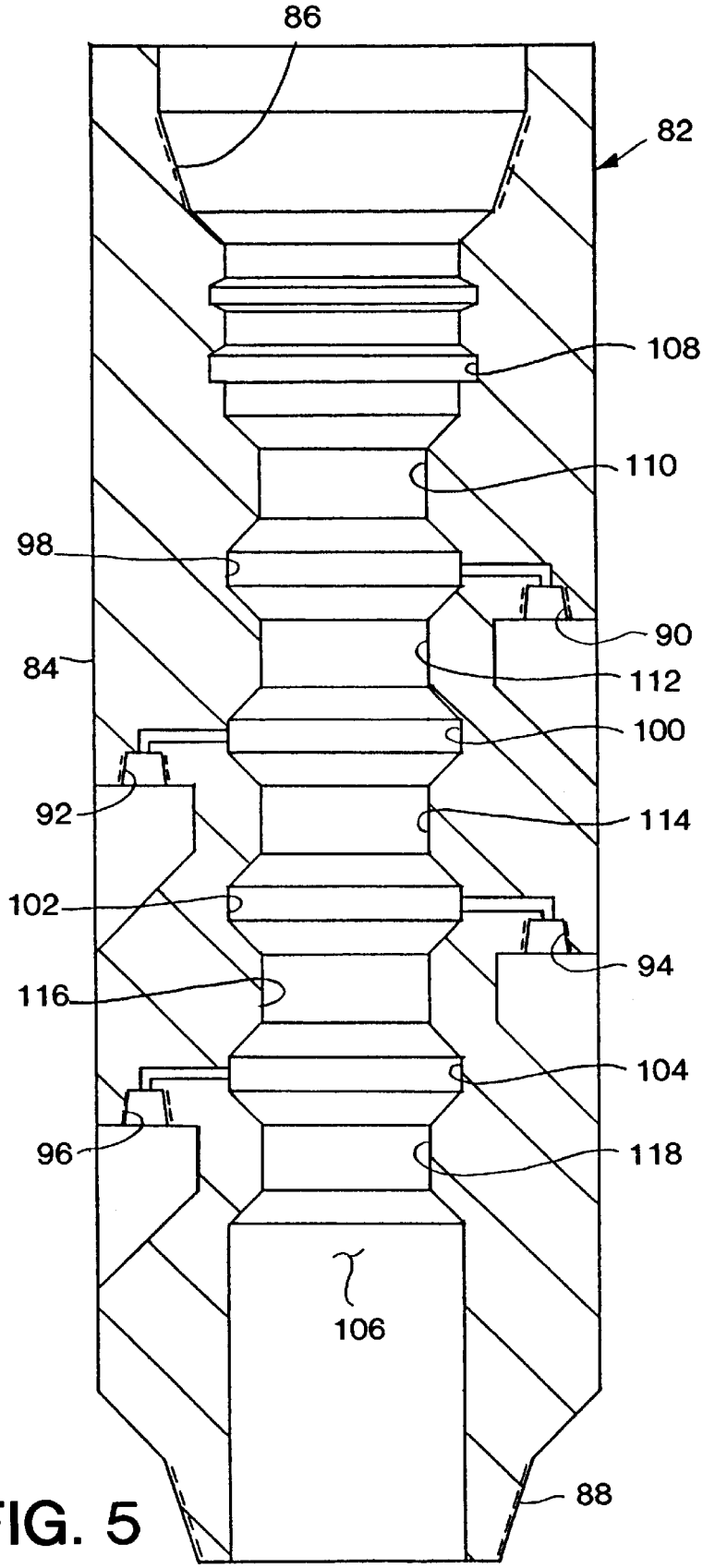
FIG. 5 is a cross-sectional view of a first hydraulic manifold embodying principles of the present invention.

Referring additionally now to FIG. 5, a hydraulic manifold 82 embodying principles of the present invention is representatively and schematically illustrated. The manifold 82 may be utilized for the manifold 68 in the method 46 and/or in the method 48. However, it is to be understood that it is not necessary for the manifold 82 to be used in either of the methods 46, 48, since other manifolds, and other types of manifolds, may be utilized in the methods 46,48, and the manifold 82 may be utilized in methods other than the methods 46, 48, without departing from the principles of the present invention.

The manifold 82 includes a generally tubular housing 84 provided with upper and lower threaded connections 86, 88 for interconnection of the manifold in a tubular string. Ports 90, 92, 94, 96 are formed in the housing 84 and provide for external connection of lines thereto. Of course, if hydraulic paths other than external lines are desired, the ports 90, 92, 94, 96 may be otherwise configured.

The ports 90, 92, 94, 96 permit fluid communication between external lines connected thereto and respective ones of a longitudinally spaced apart series of annular recesses 98, 100, 102, 104 formed internally in the housing 84. As depicted in FIG. 5, an internal flow passage 106 formed through the housing 84 is unobstructed, so each port 90, 92, 94, 96 is in fluid communication with the passage. In this manner, a tool, such as the tool 10 described above, may be connected via hydraulic paths to the manifold 82 and be pressure balanced, for example, if the port 90 is connected to the port 24 of the tool and the port 92 is connected to the port 26 of the tool. Thus, it may be seen that, interconnected in this manner, pressure fluctuations may be experienced in the flow passage 106, without causing inadvertent operation of the tool 10.

A locating or latching profile 108 is formed internally in the housing 84 to provide a convenient means of positioning a discriminator or selector relative to the housing 84. As described above for the methods 46, 48, a landing nipple may be separately provided in which a locating or latching profile is formed. Thus, it will be readily appreciated that the location of the profile 108 may be in the housing 84 or external thereto. Additionally, it is to be understood that other means of positioning a selector or discriminator relative to the manifold 82, such as a no-go diameter, etc., may be utilized without departing from the principles of the present invention.

The housing 84 further has a series of longitudinally spaced apart seal bores 110, 112, 114, 116, 118 formed therein. Three of the seal bores 112, 114, 116 are positioned between adjacent ones of the recesses 98, 100, 102, 104, one of the seal bores 110 is positioned above the recesses, and another of the seal bores 118 is positioned below the recesses. As described more fully below, sealing engagement with some or all of the bores 110, 112, 114, 116, 118 by a selector, discriminator or other member is utilized to select certain of the ports 90, 92, 94, 96 for fluid communication with one or more fluid pressure sources and/or with one or more fluid reservoirs.

Figure 6:
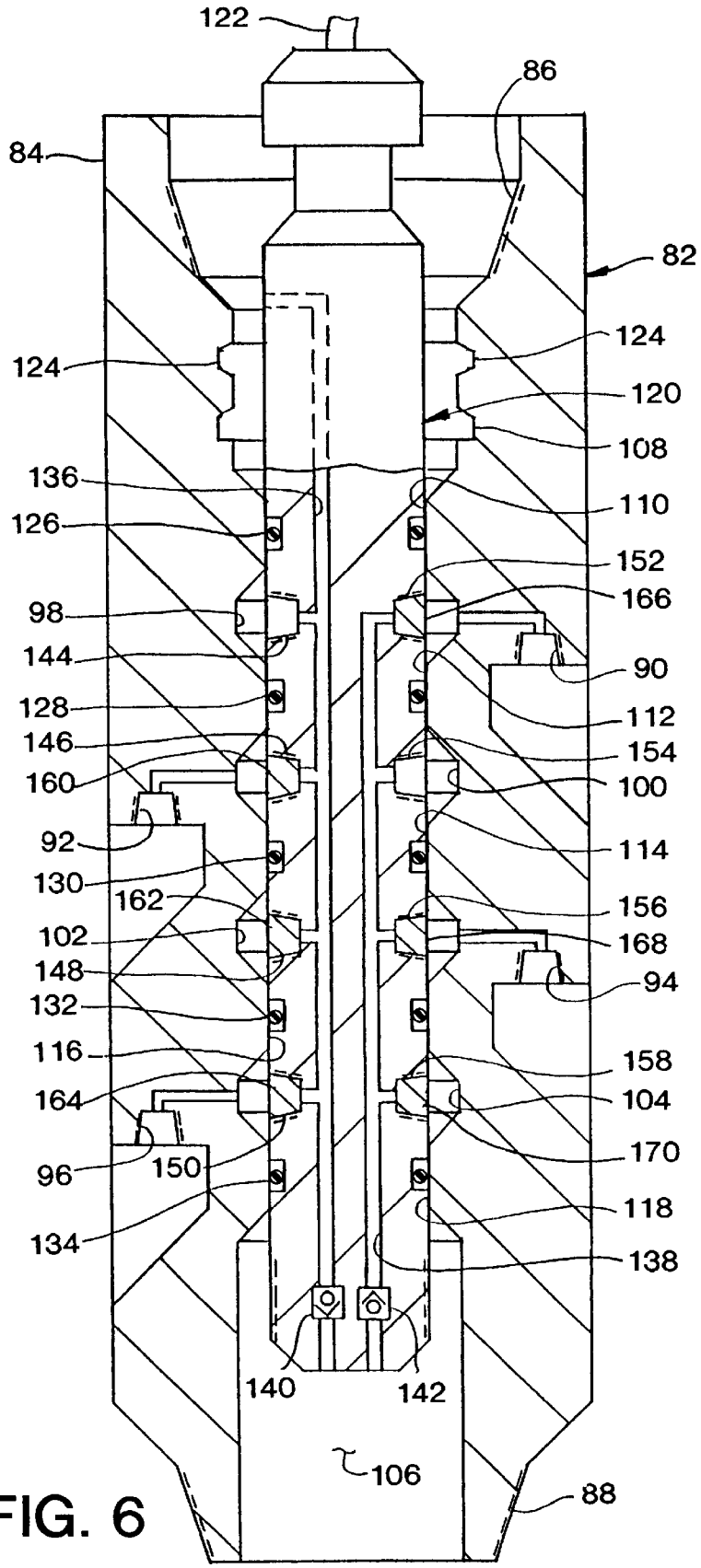
FIG. 6 is a cross-sectional view of the first manifold and a first hydraulic path selector engaged therewith, the selector embodying principles of the present invention.

Referring additionally now to FIG. 6, the manifold 82 is schematically and representatively illustrated with a hydraulic path selector or discriminator 120 embodying principles of the present invention operatively engaged therewith. The selector 120 is shown configured for conveyance by a slickline or wireline 122 attached thereto, but it is to be understood that the selector may be otherwise conveyed, such as by a fluid conduit, circulation through a tubing string, etc., without departing from the principles of the present invention. Additionally, note that a set of keys, lugs or dogs 124 are carried on the selector 120 for engagement with the profile 108 in a conventional manner, but it is to be understood that the keys may be otherwise located, for example, where the profile 108 is formed in a separate nipple or other device, or other means of positioning the selector relative to the manifold 82 may be utilized, without departing from the principles of the present invention.

The keys 124 may be of the type which are selectively engageable with only one or more certain profiles, so that the selector 120 may be conveyed through other profiles before the keys operatively engage the profile 108, thus enabling the selector to be positioned within a certain one of multiple manifolds, or at least preventing the keys from inadvertently engaging an inappropriate profile. An acceptable discriminating key/profile engagement system for use with the selector 120 and manifold 82 is the Select 20 system available from Halliburton Energy Services, Inc., although other key/profile engagement systems, other types of key/profile engagement systems, and other positioning methods may be utilized without departing from the principles of the present invention.

The selector 120 carries a longitudinally spaced apart series of seals 126, 128, 130, 132, 134 externally thereon for sealing engagement with corresponding ones of the bores 110, 112, 114, 116, 118 in the housing 84. When sealingly engaged in the housing 84 as shown in FIG. 6, the selector 120 effectively provides fluid pressure isolation between the recesses 98, 100, 102, 104, so that fluid pressure may be applied to selected ones of the ports 90, 92, 94, 96 as desired. However, it is to be clearly understood that it is not necessary for a fluid path selector incorporating principles of the present invention to provide fluid pressure isolation between each recess formed in a manifold housing, since it may at times be desired for certain of the recesses to remain in fluid communication, for example, to maintain a tool connected thereto in pressure balance while another tool is operated via fluid pressure applied to other of the recesses.

Furthermore, the seal 126 provides fluid pressure isolation between the flow passage 106 above the upper seal bore 110 and the upper recess 98, and the seal 134 provides fluid pressure isolation between the flow passage 106 below the lower seal bore 118 and the lower recess 104. However, such fluid pressure isolation may not be necessary in some circumstances, for example, when it is desired to apply fluid pressure to the recess 98 via the flow passage 106 above the seal bore 110, or when it is desired to provide fluid communication between the recess 104 and the flow passage below the seal bore 118. Thus, the selector 120 may sealingly engage the housing 84 in other manners, without departing from the principles of the present invention.

Two longitudinal fluid passages 136, 138 are formed internally in the selector 120. One of the passages 136 is in fluid communication with the flow passage 106 above the upper seal bore 110. The other passage 138 is in fluid communication with the flow passage 106 below the lower seal bore 118. The passages 136, 138 permit fluid pressure and/or differential fluid pressure to be applied to one or more tools connected to the manifold 82 in a manner described more fully below. Note that the passage 136 may have a check valve 140 connected thereto providing fluid communication between the passage 106 below the lower seal bore 118 and the passage 136 when pressure in the passage 106 below the seal bore 118 exceeds that in the passage 136, but such check valve and associated fluid communication provided thereby is not necessary for practicing the principles of the present invention. For example, in other embodiments of the selector 120, no fluid communication may be provided at all between the passage 136 and the passage 106 below the lower seal bore 118. The passage 138 may have a check valve 142 connected thereto for providing fluid communication between the passage 138 and the passage 106 below the lower seal bore 118 when pressure in the passage 138 exceeds pressure in the passage 106 below the lower seal bore 118. However, the check valve 142 is not necessary, and in other embodiments of the selector 120, fluid communication may be continuously provided between the passage 138 and the passage 106 below the lower seal bore 118.

The selector 120 includes ports 144, 146, 148, 150 formed thereon, which provide fluid communication between the passage 136 and corresponding ones of the recesses 98, 100, 102, 104. In a similar manner, ports 152, 154, 156, 158 formed on the selector 120 provide fluid communication between the passage 138 and corresponding ones of the recesses 98, 100, 102, 104. Thus, each of the internal passages 136, 138 of the selector 120 may be in fluid communication with any of the recesses 98, 100, 102, 104. Furthermore, it follows that the passage 106 above the upper seal bore 110, and the passage 106 below the lower seal bore 118 may each be in fluid communication with any of the recesses 98, 100, 102, 104 and, therefore, any of the ports 90, 92, 94, 96.

By plugging one or more of the ports 144, 146, 148, 150, 152, 154, 156, 158 in the selector 120 prior to its being conveyed into the manifold 82, the selector may conveniently be preconfigured to provide fluid communication between selected ones of the ports 90, 92, 94, 96 and either or both of the passages 136, 138. As shown in FIG. 6, the selector 120 has been configured to provide fluid communication between the port 90 and the passage 136, and between the port 92 and the passage 138. Plugs 160, 162, 164 installed in ports 146, 148, 150, respectively, prevent fluid communication between the passage 136 and any of the ports 92, 94, 96, and plugs 166, 168, 170 installed in ports 152, 156, 158, respectively, prevent fluid communication between the passage 138 and any of the ports 90, 94, 96. Thus, fluid pressure in the passage 136 is only communicated to manifold port 90, and fluid pressure in the passage 138 is only communicated to manifold port 92.

It will be readily appreciated by one skilled in the art that, if the ports 90, 92 are connected to the ports 24, 26, respectively, of the tool 10 as depicted in the method 46 shown in FIG. 3, the tool may be operated by applying fluid pressure to the tubing string 50. For example, fluid pressure applied to the tubing string 50 is transmitted to the passage 106 of the housing 84 above the upper seal bore 110. This pressure is then transmitted via the passage 136 in the selector 120 to the port 144 and then to the port 90. From the port 90, the pressure is transmitted via a hydraulic path of the set of lines 64 to the port 24 of the tool 10. The passage 138 of the selector 120 is in fluid communication with the passage 106 below the lower seal bore 118, which is isolated from the fluid pressure applied to the tubing string 50 above the upper seal bore 110. Thus, this fluid pressure is not transmitted from the port 92 to the port 26 via a hydraulic path of the set of lines 64 and, therefore, a pressure differential exists at the ports 24, 26 of the tool 10. This pressure differential is used to downwardly displace the sleeve 18 relative to the housing 20 of the tool 10 as described above.

If it were desired to upwardly displace the sleeve 18 relative to the housing 20, the selector 120 would instead be preconfigured so that fluid pressure applied to the tubing string 50 above the manifold 82 would be transmitted to the port 26 of the tool 10, and the port 24 would be placed in fluid communication with the passage 106 below the lower seal bore 118 via the passage 138. To accomplish this, the plug 160 could be installed in port 144, leaving port 146 open, and plug 166 could be installed in port 154, leaving port 152 open. Thus, it may be seen that the selector 120 may be easily configured as desired to operate a tool connected to the manifold 82 in various manners.

The selector 120 and manifold 82 have been described above as they may be used to operate a flow control device, such as the tool 10, in the method 46. However, it is to be clearly understood that a vast number of different applications exist for these versatile elements. For example, if a tool, such as the tool 12 shown in FIG. 2 is connected to the manifold 82, only one of the ports 90, 92, 94, 96 may be connected to the tool, and a series of pressure applications to this port may be used to operate the tool, instead of a pressure differential between ports of the manifold. Fluid flow through selected ones of the ports 90, 92, 94, 96, instead of fluid pressure, may be used to operate one or more tools connected thereto. The manifold 82 may be connected to one tool or many tools. Fewer or greater numbers of the ports 90, 92, 94, 96 may be provided in the manifold 82. Multiple manifolds 82 may be used in the methods 46, 48. The selector 120 may be configured so that fluid pressure transmitted therethrough, or at least through the manifold 82, is used to operate more than one tool connected to the manifold. Instead of a pressure differential being created to operate a tool connected to the manifold 82 by applying fluid pressure to one or more of the manifold ports 90, 92, 94, 96, the pressure differential may be created by providing fluid communication between one or more of the ports and an area of reduced fluid pressure relative to that in the passage 106, such as an atmospheric chamber disposed within the selector 120. These and many other modifications to the particular embodiment of the manifold 82 and selector 120 representatively illustrated in FIG. 6 may be made without departing from the principles of the present invention.

Hereinbelow are described several additional embodiments of manifolds and selectors, which each embody principles of the present invention. However, it is to be clearly understood that, by describing specific alternate embodiments, the principles of the present invention are not thereby limited only to those embodiments described. Rather, the description of additional embodiments is intended to illustrate the ease by which the principles of the present invention may be adapted to accomplish any of a number of desired results. This adaptability is one of the primary benefits of the present invention. For example, some or all of the modifications outlined above may be incorporated into each of the embodiments described below.

Figure 7:
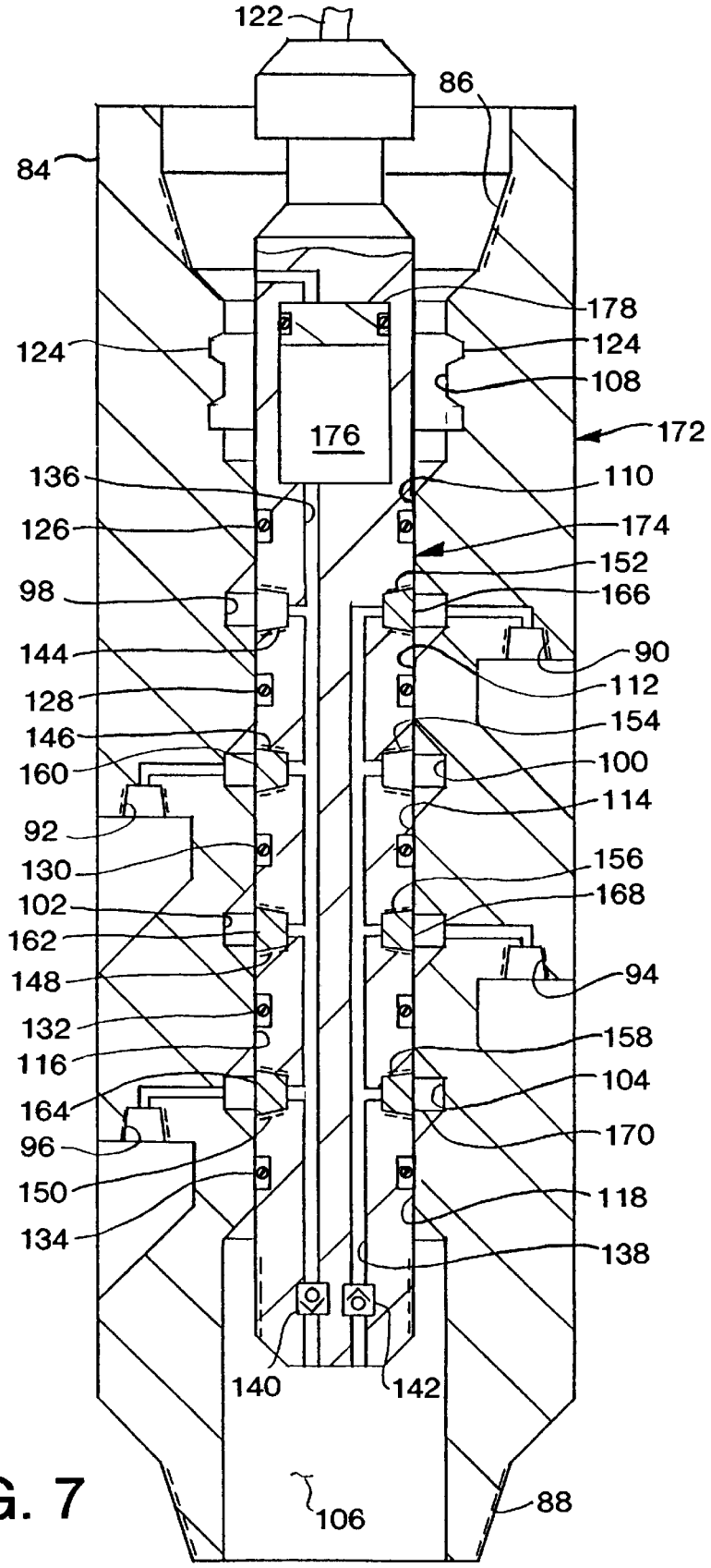
FIG. 7 is a cross-sectional view of a second hydraulic manifold and a second hydraulic path selector engaged therewith, the manifold and selector embodying principles of the present invention.

Referring additionally now to FIG. 7, another hydraulic manifold 172 and hydraulic path selector 174 embodying principles of the present invention are representatively and schematically illustrated. The manifold 172 and selector 174 are very similar in most respects to the manifold 82 and selector 120 described above, and the common features between them are indicated using the same reference numbers and will not be described again herein. The manifold 172, in particular, is identical to the manifold 82 described above. The selector 174, however, differs in at least one substantial respect as compared to the selector 120 described above.

The selector 174 includes a fluid chamber 176 disposed therein. The fluid chamber 176 permits a certain fluid to be conveyed along with the selector 174, so that the fluid is available downhole to operate a tool connected to the manifold 172. Of course, it is not necessary for the fluid chamber 176 to be disposed within the selector 174, since it could be disposed in a separate housing attached to the selector, or otherwise conveyed into the well so that it is available for use in operating a tool connected to the manifold 172.

It may be desirable to convey a certain fluid, or type of fluid, into the well with the selector 174 for a variety of reasons, such as, to operate a tool which requires that certain fluid for its operation, to operate a tool with a clean fluid as opposed to the fluid present in the well, to operate a tool in a particular manner using a certain volume or quantity of fluid, etc. For example, where the tool is a flow choke through which the rate of fluid flow may be relatively precisely adjusted by displacing a choking member therein relatively precise distances, a particular volume of fluid may be discharged from the selector 174 into the tool via one or more of the ports of the manifold 172 to thereby produce a corresponding particular displacement of the choking member.

In the selector 174 representatively illustrated in FIG. 7, fluid in the chamber 176 may be discharged from the selector by applying fluid pressure to a tubing string attached above the manifold 172 to thereby cause a piston 178 in the chamber 176 to displace downwardly. Such downward displacement of the piston 178 causes fluid in the chamber 176 to flow through the passage 136 and outward through the port 144. The fluid may then be transmitted to a port of a tool connected to the manifold 172 via the manifold port 90. If it is desired to discharge only a certain quantity or volume of the fluid from the selector 174 into the manifold 172, the chamber 176 may only contain that quantity or volume of fluid when the selector is conveyed into the well. Thus, it may be seen that the selector 174 permits a known fluid, and/or a known quantity of fluid, to be delivered for operation of a tool as selected by engagement of the selector with the manifold 172.

Figure 8:
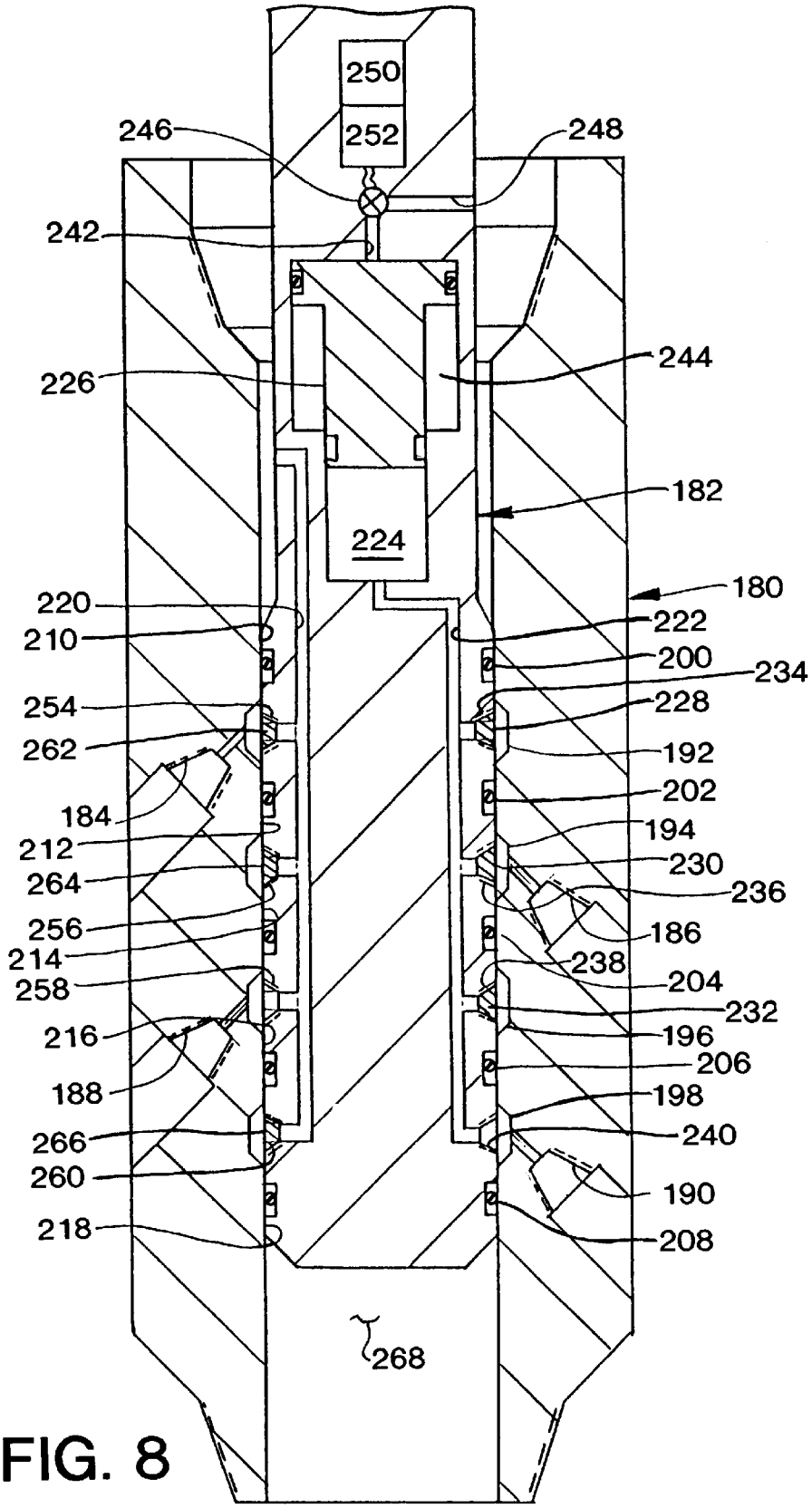
FIG. 8 is a cross-sectional view of a third hydraulic manifold and a third hydraulic path selector engaged therewith, the manifold and selector embodying principles of the present invention.

Referring additionally now to FIG. 8, another hydraulic manifold 180 and hydraulic path selector 182 embodying principles of the present invention are schematically and representatively illustrated. The manifold 180 and selector 182 are similar in many respects to those described above. However, the selector 182 is uniquely configured to permit operation of one or more tools connected to the manifold 180, without requiring additional or increased fluid pressure to be separately applied to any tubing string or other portion of the well.

The selector 182 may be positioned in the manifold 180 as shown in FIG. 8 using a variety of methods. For example, a conventional lock mandrel or other locating device may be attached to the selector 182 and engaged with a landing nipple, such as the landing nipple 70 in the methods 46, 48, or the selector may be provided with keys, lugs or dogs, such as keys 124, for engagement with an internal profile, such as profile 108, as described above for the manifold 172 and selector 174, etc. It is to be clearly understood that any method of positioning the selector 182 relative to the manifold 180 may be utilized, without departing from the principles of the present invention.

The manifold 180 includes external ports 184, 186, 188, 190 in fluid communication with respective internal annular recesses 192, 194, 196, 198. The selector 182 carries seals 200, 202, 204, 206, 208 externally thereon for engagement with respective seal bores 210, 212, 214, 216, 218 formed in the manifold 180 alternating with the recesses 192, 194, 196, 198. The selector 182 also includes two fluid passages 220, 222 extending generally longitudinally therein.

The passage 222 is in fluid communication with a fluid chamber 224. A piston 226 is reciprocably and sealingly disposed in the selector 182, so that downward displacement of the piston will cause discharge of fluid from the chamber 224 into the passage 222. Plugs 228, 230, 232 are installed in respective ports 234, 236, 238, so that fluid discharged into the passage 222 from the chamber 224 will be directed to flow outward only through a manifold port 240. Of course, the selector 182 may be configured so that the fluid in the chamber 224 flows outward through any port or combination of the ports 234, 236, 238, 240 as desired by accordingly installing or not installing plugs in the ports.

Fluid is discharged from the chamber 224 by admitting fluid pressure into a fluid passage 242 in fluid communication with the piston 226 opposite the chamber. An atmospheric chamber 244 ensures that a downwardly biasing pressure differential is created across the piston 226 when fluid pressure is admitted to the passage 242.

To admit fluid pressure to the passage 242, an electrically operated valve 246 is opened to thereby provide fluid communication between the passage 242 and a fluid passage 248 extending to the exterior of the selector 182. It will be readily appreciated by one skilled in the art that, if the manifold 180 is interconnected in a tubing string, such as the tubing string 50 in the method 46 or 48, hydrostatic pressure may exist in the tubing string surrounding the selector 182. This hydrostatic pressure will cause a downwardly biasing force to be applied to the piston 226 when the valve 246 is opened.

To open the valve 246, the selector 182 includes a battery 250 and an electronic device 252 interconnected to the valve. The electronic device 252 may be an ETD ("electronic timing device") available from Halliburton Energy Services, Inc. The ETD applies electrical power to an electrically operated device connected thereto, such as the valve 246, when an accelerometer of the ETD indicates that it has remained motionless for a predetermined period of time. Thus, when the selector 182 has been engaged with the manifold 180 for a predetermined period of time, the electronic device 252 may apply power from the battery 250 to the valve 246 to open the valve. However, it is to be understood that any other means of opening the valve 246 may be utilized, without departing from the principles of the present invention. For example, if the selector 182 is conveyed into the well suspended from a wireline or electric line, power to open the valve 246 may be applied directly from the wireline or electric line to the valve, without need of the battery 250 or electronic device 252. Alternatively, engagement of the selector 182 with the manifold may automatically cause power to be supplied from the battery 250 to the valve 246, without need of the electronic device 252. As another alternative, the valve 246 could be mechanically operable, etc.

The passage 220 provides fluid communication between one or more of ports 254, 256, 258, 260 extending outwardly therefrom. The ports 254, 256, 258, 260 may be placed in fluid communication with the ports 184, 186, 188, 190, respectively, depending upon whether plugs have been installed in the particular ports 254, 256, 258, 260. As shown in FIG. 8, plugs 262, 264, 266 have been installed in ports 254, 256, 260, respectively, thereby placing only manifold port 188 in fluid communication with the passage 220. Of course, others of the ports 184, 186, 188, 190, and combinations of these, may be placed in fluid communication with the passage 220 as desired.

The passage 220 is in fluid communication with an internal flow passage 268 of the manifold 180 above the upper seal bore 210. When the selector 182 is engaged with the manifold 180, passage 222 is in fluid communication with only manifold port 190, and passage 220 is in fluid communication with only manifold port 188. When the valve 246 is opened, fluid is discharged from the chamber 224 into the passage 222, and then flowed to a tool port connected to port 190. Fluid pressure in the passage 268 above the upper seal bore 210 is continuously applied via the passage 220 to a tool port connected to port 188. It will be readily appreciated by one skilled in the art that the fluid pressure delivered to port 190 will exceed the fluid pressure delivered to port 188, due to the differential area of the piston 226, and this fluid pressure differential may be utilized to operate a tool as described above. Additionally, due to the use of the fluid chamber 224 of the selector 182, a desired fluid, and/or a known quantity of the fluid, may be discharged from the selector 182 to operate the tool.

Figure 9:
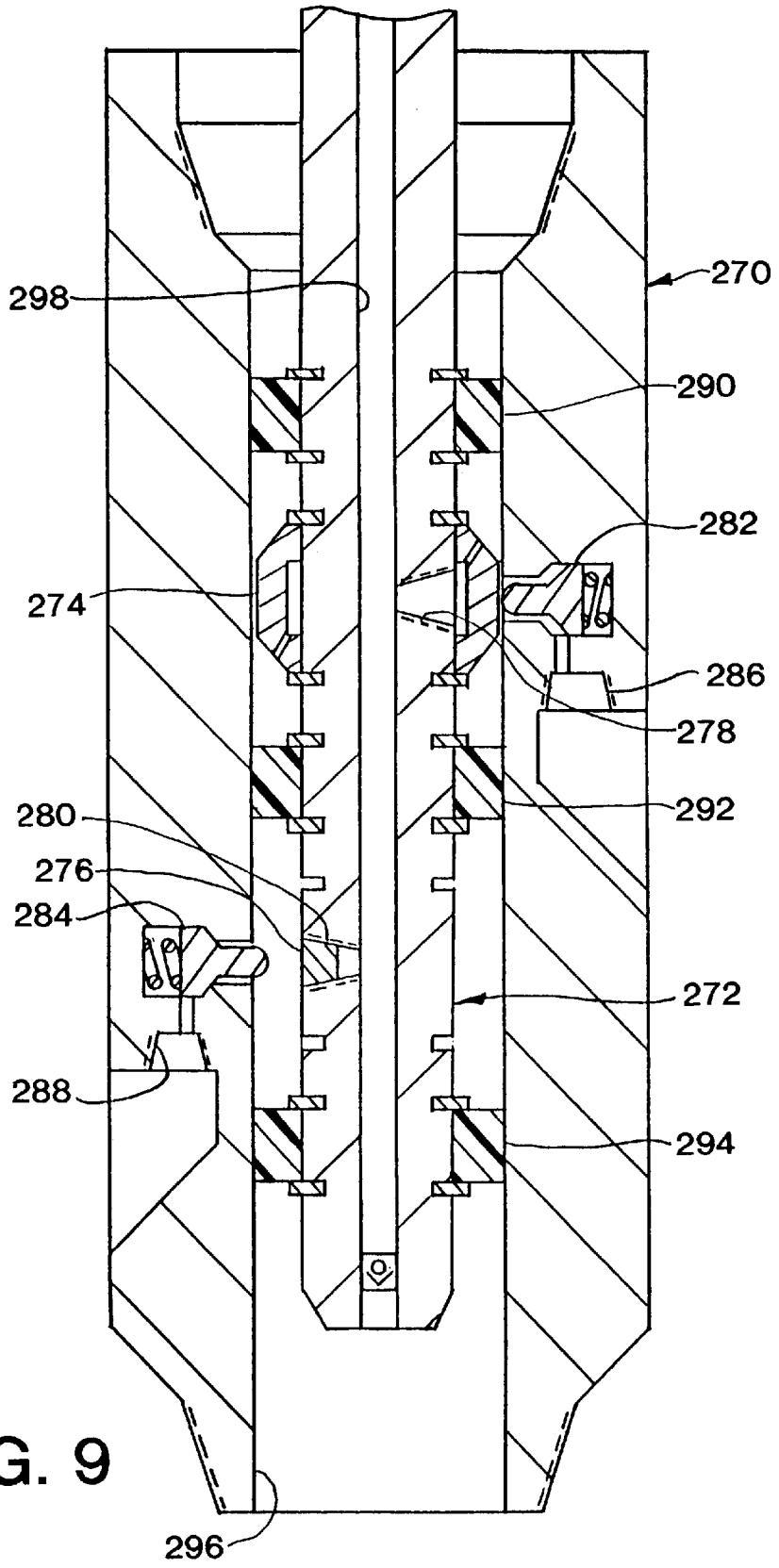
FIG. 9 is a cross-sectional view of a fourth hydraulic manifold and a fourth hydraulic path selector engaged therewith, the manifold and selector embodying principles of the present invention.

Referring additionally now to FIG. 9, another hydraulic manifold 270 and hydraulic path selector 272 embodying principles of the present invention are schematically and representatively illustrated. The manifold 270 and selector 272 are similar in many respects to those described above, but differ in at least three significant respects. In one of these respects, a hydraulic path is selected by the selector 272 by either installing or not installing thereon a radially enlarged ring or projection 274, as well as installing or not installing a plug 276 in one or more ports 278, 280 of the selector. If installed, the ring 274 will engage and open a valve 282, 284 associated with respective ones of ports 286, 288. In another of these respects, individual seal bores and annular recesses are not provided in the manifold 270. Instead, packings 290, 292, 294 are sealingly engaged with an internal bore 296 formed through the manifold 270 when the selector 272 is engaged with the manifold. In another of these respects, only a single flow passage 298 is formed longitudinally in the selector 272.

The selector 272 may be positioned in the manifold 270 as shown in FIG. 9 using a variety of methods. For example, a conventional lock mandrel or other locating device may be attached to the selector 272 and engaged with a landing nipple, such as the landing nipple 70 in the methods 46, 48, or the selector may be provided with keys, lugs or dogs, such as keys 124, for engagement with an internal profile, such as profile 108, as described above for the manifold 172 and selector 174, etc. It is to be clearly understood that any method of positioning the selector 272 relative to the manifold 270 may be utilized, without departing from the principles of the present invention.

As depicted in FIG. 9, the ring 274 is positioned opposite the valve 282 when the selector 272 is engaged in the manifold 270. The ring 274 opens the valve 282, thereby permitting fluid communication between the port 286 and the passage 298. The passage 298 may be in fluid communication with a tubing string, such as tubing string 50 in the methods 46, 48, or the passage 298 may be in fluid communication with a fluid conduit, such as coiled tubing, with which the selector 272 is conveyed into the well.

The passage 298 is not in fluid communication with the manifold port 288, due to installation of the plug 276 in the port 280, and also due to the absence of a ring 274 installed on the selector 272 opposite the valve 284. Thus, fluid pressure in the passage 298 may be applied to operate a tool connected to port 286, but not to operate another tool connected to port 288. Of course, the ports 286, 288 may be connected to separate tools, or may be connected to different portions of the same tool. The valves 282, 284 help to prevent contamination of fluid communicated with tools connected to the ports 286, 288.

Figure 10:
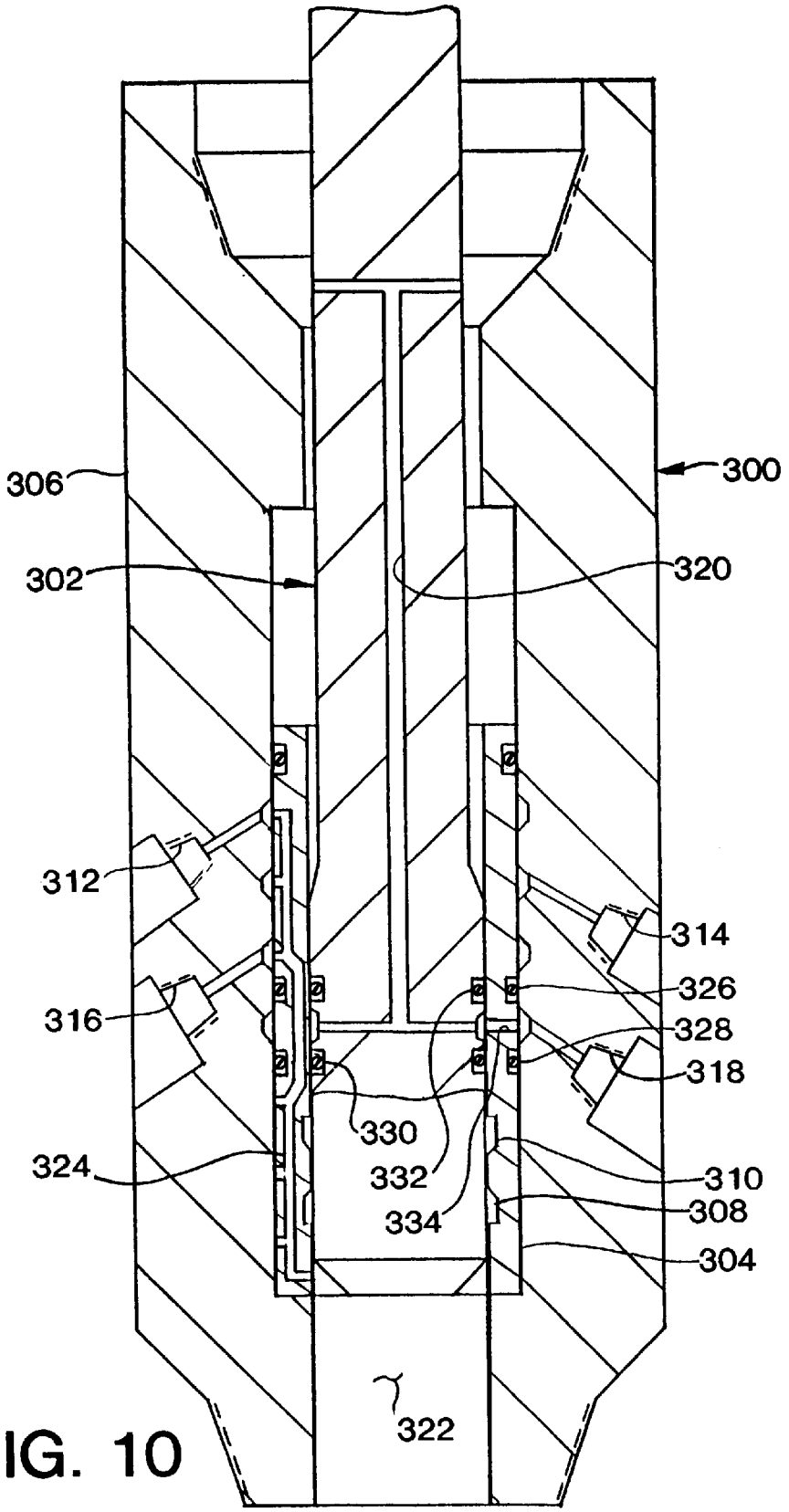
FIG. 10 is a cross-sectional view of a fifth hydraulic manifold and a fifth hydraulic path selector engaged therewith, the manifold and selector embodying principles of the present invention.

Referring additionally now to FIG. 10, a hydraulic manifold 300 and hydraulic path selector 302 embodying principles of the present invention are representatively and schematically illustrated. The manifold 300 is similar in most respects to the manifolds described above, but differs in at least one significant respect in that a sleeve 304 is sealingly and reciprocably disposed within a housing 306 of the manifold. The sleeve 304 has a latching or locating profile 308 formed internally therein, which is engaged by keys, lugs or dogs 310 carried on the selector 302. By displacing the selector 302 relative to the housing 306 after the keys 310 are engaged with the profile 308, one of multiple ports 312, 314, 316, 318 formed in the housing 306 may be placed in fluid communication with an internal generally longitudinally extending passage 320 formed in the selector.

The housing 306 has internal seal bores and annular recesses formed therein in a manner similar to other manifolds described above. The sleeve 304 carries seals 326, 328 externally thereon for sealing engagement with selected ones of the seal bores. When the selector 302 is engaged with the sleeve 304, seals 330, 332 carried externally on the selector are sealingly engaged with the interior of the sleeve. An aperture 334 formed laterally through a sidewall of the sleeve 304 is thereby placed in fluid communication with the passage 320 and one of the recesses straddled by the seals 326, 328. In this manner, the passage 320 is placed in fluid communication with only one of the ports 312, 314, 316, 318.

As depicted in FIG. 10, the sleeve 304 is in a position in which port 318 is placed in fluid communication with the passage 320. The remainder of the ports 312, 314, 316 are placed in fluid communication with a flow passage 322 formed through the housing 306 below the selector 302 via a fluid passage 324 formed internally in a sidewall of the sleeve 304. It will be readily appreciated that, if the sleeve 304 is displaced upwardly by the selector 302 relative to the housing 306, so that the manifold port 316 is placed in fluid communication with the passage 320, the remainder of the ports 312, 314, 318 will be placed in fluid communication with the passage 322 below the selector 302. Thus, the engagement of the selector 302 with the sleeve 304, and the ability to displace these elements relative to the housing 306, permits one of the ports 312, 314, 316, 318 to be placed in fluid communication with the passage 320, while the remainder of the ports are placed in fluid communication with the passage 322 below the selector.

The passage 320 as depicted in FIG. 10 is in fluid communication with the passage 322 above the sleeve 304. However, it is to be clearly understood that the passage 320 may be in fluid communication with other sources of fluid power, such as a fluid conduit attached to the selector 302, without departing from the principles of the present invention.

Figure 11:
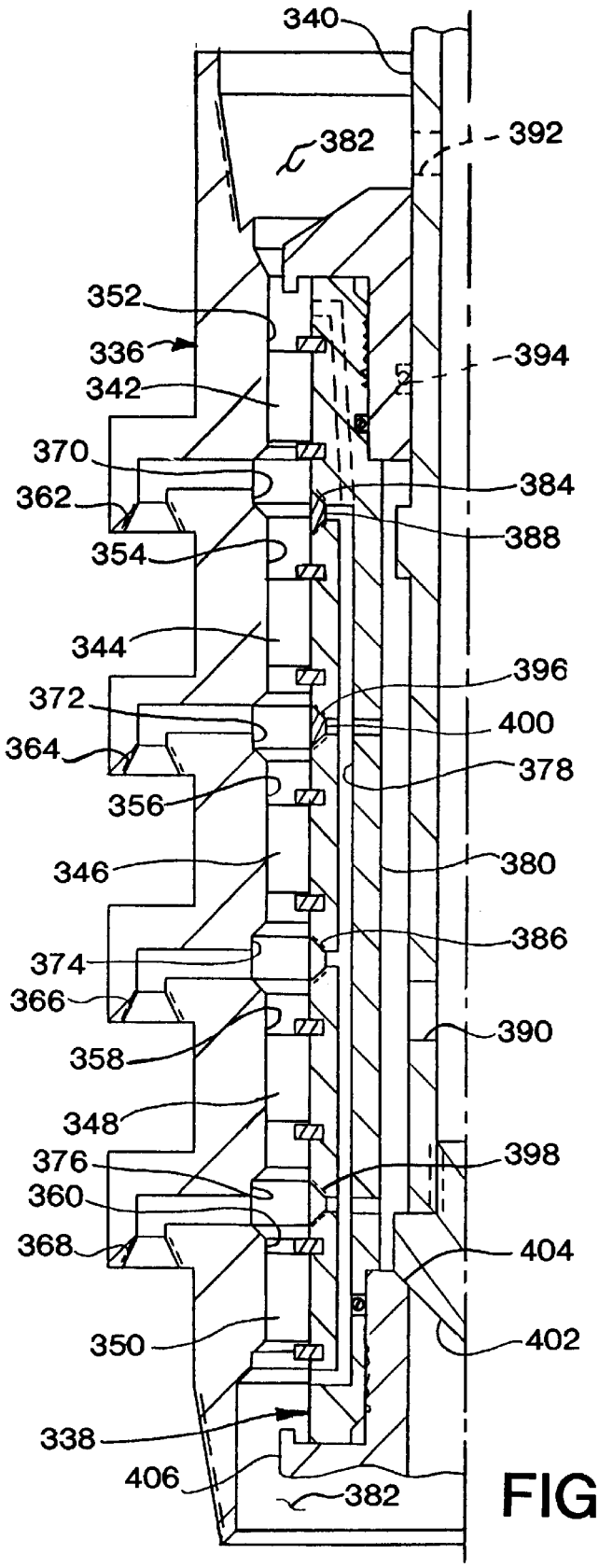
FIG. 11 is a cross-sectional view of a sixth hydraulic manifold and a sixth hydraulic path selector engaged therewith, the manifold and selector embodying principles of the present invention.

Referring additionally now to FIG. 11, another hydraulic manifold 336 and hydraulic path selector 338 embodying principles of the present invention are representatively and schematically illustrated. The selector 338 is conveyed into the well attached to a fluid conduit, such as a coiled tubing string 340. The coiled tubing string 340 provides a convenient means of conveying the selector 338 in highly deviated wells, or in circumstances where the TFL system is unavailable, no returns are possible, etc. Additionally, the coiled tubing string 340 may provide a source of fluid power to operate one or more tools connected to the manifold 336.

The selector 338 may be positioned in the manifold 336 as shown in FIG. 11 using a variety of methods. For example, a conventional lock mandrel or other locating device may be attached to the selector 338 and engaged with a landing nipple, such as the landing nipple 70 in the methods 46, 48, or the selector may be provided with keys, lugs or dogs, such as keys 124, for engagement with an internal profile, such as profile 108, as described above for the manifold 172 and selector 174, etc. It is to be clearly understood that any method of positioning the selector 338 relative to the manifold 336 may be utilized, without departing from the principles of the present invention.

The selector 338 is engaged within the manifold 336 in a manner similar to that in which previously described selectors engage their associated manifolds. That is, the selector 338 carries a series of longitudinally spaced apart packings or seals 342, 344, 346, 348, 350 externally thereon for sealing engagement with respective longitudinally spaced apart seal bores 352, 354, 356, 358, 360 formed internally in the manifold 336. A corresponding series of ports 362, 364, 366, 368 are formed on the manifold 336 and are in fluid communication with respective annular recesses 370, 372, 374, 376 formed internally in the manifold 336 between adjacent ones of the seal bores 352, 354, 356, 358, 360.

The selector 338 has two generally longitudinally extending fluid passages 378, 380 formed therein. For illustrative convenience, the passages 378, 380 are depicted in FIG. 11 as if they coexist in a sidewall of the selector 338, but preferably the passages are circumferentially offset in the sidewall. One of the passages 378 is in fluid communication with an internal flow passage 382 formed through the manifold 336 below the lower seal bore 360. Selected ones of the ports 362, 366 may be placed in fluid communication with the passage 378, depending upon whether plugs are installed in ports 384, 386 extending outwardly from the passage 378. As depicted in FIG. 11, a plug 388 is installed in the port 384, thereby preventing fluid communication between the passage 378 and the port 362. Of course, the passage 378 could also be placed in fluid communication with either of the ports 364, 368 by providing additional ports extending outwardly from the passage 378, if desired.

The passage 380 of the selector 338 is in fluid communication with the coiled tubing string 340 via an opening 390 formed through a sidewall of the coiled tubing string within the selector 338. As depicted in FIG. 11, the passage 380 may also be in fluid communication with the passage 382 above the upper seal bore 352 via an optional opening 392 shown in dashed lines in FIG. 11. Thus, fluid pressure may be applied to the passage 380 from the passage 382 above the seal bore 352 and/or from the interior of the coiled tubing string 340. If it is desired to apply fluid pressure to the passage 380 exclusively from the coiled tubing string 340, and to isolate the interior of the coiled tubing from the passage 382 above the upper seal bore 352, the opening 392 should not be provided, but an optional seal 394 shown in dashed lines in FIG. 11 should be provided.

The passage 380 may be in fluid communication with one or both of the ports 364, 368 via ports 396, 398 extending outwardly from the passage 380. As shown in FIG. 11, a plug 400 is installed in the port 396, thereby preventing fluid communication between the passage 380 and the port 364. Of course, the passage 380 could be placed in fluid communication with either or both of the ports 362, 366 by providing additional ports extending outwardly from the passage 380.

A lower end of the coiled tubing string 340 has a valve member/plug 402 installed therein. The member 402 performs a plug function by preventing fluid communication through the lower end of the coiled tubing string 340. The member 402 performs a valve function by sealingly engaging a seal surface 404 formed on a lower connector 406 of the selector 338. The member 402 and connector 406 together form a check valve that closes, preventing fluid flow from the passage 380 to the passage 382 below the lower seal bore 360, when fluid pressure in the passage 380 exceeds fluid pressure in the passage 382 below the lower seal bore 360. The check valve may be opened, however, by picking up on the coiled tubing string 340 and lifting the member 402 off of the seal surface 404. This may aid in retrieving the selector 338 from the manifold 336 by preventing a hydraulic lock below the selector.

Note that the passage 378 could alternatively be in fluid communication with the passage 382 above the upper seal bore 352 by extending the passage 378 as indicated by the dashed lines extending upwardly from the passage 378 in FIG. 11. In that case, it may not be desired to have the passage 378 in fluid communication with the passage 382 below the lower seal bore 360. However, if the coiled tubing string 340 is to serve as the exclusive source of fluid power to operate tools connected to the manifold 336 as described above, then it may be desirable to have the passage 378 in fluid communication with the passage 382 both above and below the selector 338, in order to pressure balance the selector in the manifold 336. Another alternative would be to provide fluid communication between the passage 378 and the passage 382 above the upper seal bore 352, but isolate the passage 378 from the passage 382 below the lower seal bore 360, and isolate the passage 382 above the upper seal bore 352 from the interior of the coiled tubing string 340, thereby making the passage 382 above the seal bore 352 the exclusive source of elevated fluid pressure to operate tools connected to the manifold 336, and using the coiled tubing string 340 as a source of reduced fluid pressure as compared to that in the passage 382 above the upper seal bore 352. In this manner, a fluid pressure differential could be applied to a tool connected to the manifold 336, without the need of applying fluid pressure to either of the coiled tubing string 340 or the passage 382 above the upper seal bore 352. It will, thus, be readily appreciated that many variations of the selector 338 may be promulgated, without departing from the principles of the present invention.

Figure 12:
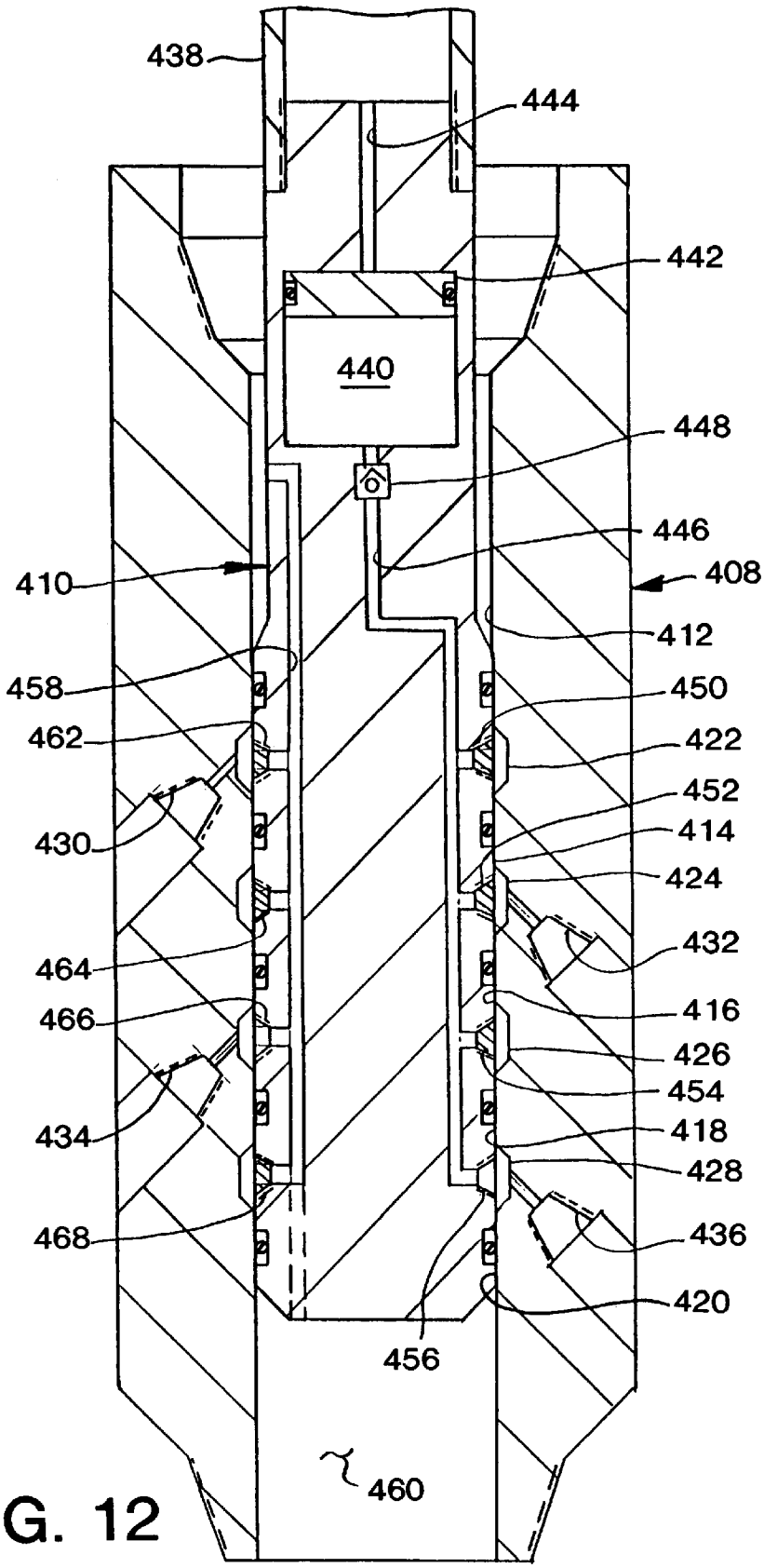
FIG. 12 is a cross-sectional view of a seventh hydraulic manifold and a seventh hydraulic path selector engaged therewith, the manifold and selector embodying principles of the present invention.

Referring additionally now to FIG. 12, a hydraulic manifold 408 and hydraulic path selector 410 embodying principles of the present invention are representatively and schematically illustrated. The manifold 408 is similar in most respects to previously described manifolds, in that a longitudinally spaced apart series of seal bores 412, 414, 416, 418, 420 are utilized to provide fluid isolation between annular recesses 422, 424, 426, 428 formed internally in the manifold, the recesses being in fluid communication with respective ports 430, 432, 434, 436 formed through a sidewall of the manifold. The selector 410, however, differs in several significant respects from previously described selectors.

The selector 410 may be positioned in the manifold 408 as shown in FIG. 12 using a variety of methods. For example, a conventional lock mandrel or other locating device may be attached to the selector 410 and engaged with a landing nipple, such as the landing nipple 70 in the methods 46, 48, or the selector may be provided with keys, lugs or dogs, such as keys 124, for engagement with an internal profile, such as profile 108, as described above for the manifold 172 and selector 174, etc. It is to be clearly understood that any method of positioning the selector 410 relative to the manifold 408 may be utilized, without departing from the principles of the present invention.

The selector 410 is conveyed into the well attached to a coiled tubing string 438. A fluid chamber 440 is provided in the selector 410, with fluid in the chamber and a piston 442 sealingly and reciprocably disposed therein. Fluid communication is provided between the interior of the coiled tubing string 438 and the piston 442 by a fluid passage 444. When fluid pressure is applied to the interior of the coiled tubing string 438, the piston 442 is biased downwardly, thereby discharging the fluid from the chamber 440 and into a passage 446 extending generally longitudinally in the selector 410. A check valve or relief valve 448 prevents premature discharge of the fluid from the chamber 440. Alternatively, or in addition, a rupture disc or other device may be provided to ensure that a predetermined fluid pressure is applied to the chamber 440 before the fluid therein is discharged.

From the passage 446, the fluid flows outwardly through one or more of ports 450, 452, 454, 456 extending outwardly therefrom. One or more of the ports 450, 452, 454, 456 may be plugged to prevent fluid flow therethrough. As depicted in FIG. 12, the ports 450, 452, 454 are plugged, leaving only port 456 open, and providing fluid communication between the passage 446 and only manifold port 436.

Another fluid passage 458 extends generally longitudinally in the selector 410. The passage 458 is in fluid communication with a fluid passage 460 formed through the manifold 408 above the upper seal bore 412. However, as shown by the dashed lines extending downwardly from the passage 458 in FIG. 12, the passage 458 may alternatively, or additionally, be in fluid communication with the passage 460 below the lower seal bore 420 if desired. The passage 458 may be in fluid communication with any of the manifold ports 430, 432, 434, 436 via ports 462, 464, 466, 468 extending outwardly from the passage 458. As depicted in FIG. 12, ports 462, 464, 468 are plugged, leaving only port 466 open, and providing fluid communication between the passage 458 and only manifold port 434.

It will be readily appreciated that the selector 410, configured as depicted in FIG. 12, permits a desired fluid and/or a desired quantity of fluid to be discharged from the chamber 440 and through the passage 446 to a tool connected to port 436. Additionally, a fluid pressure differential may be applied to a tool connected to ports 434, 436 to operate the tool, the fluid pressure differential being the difference in pressure between that in the passage 460 above the upper seal bore 412 and/or below the lower seal bore 420, and that in the interior of the coiled tubing string 438 and applied to passage 446. Of course, tools which do not require an applied pressure differential, such as the tool 12 described above, tools which operate in response to fluid flow rather than to particular fluid pressures, and other types of hydraulically operable tools may also be operated using the manifold 408 and selector 410, or any of the manifold and selectors described above.

Figure 13:
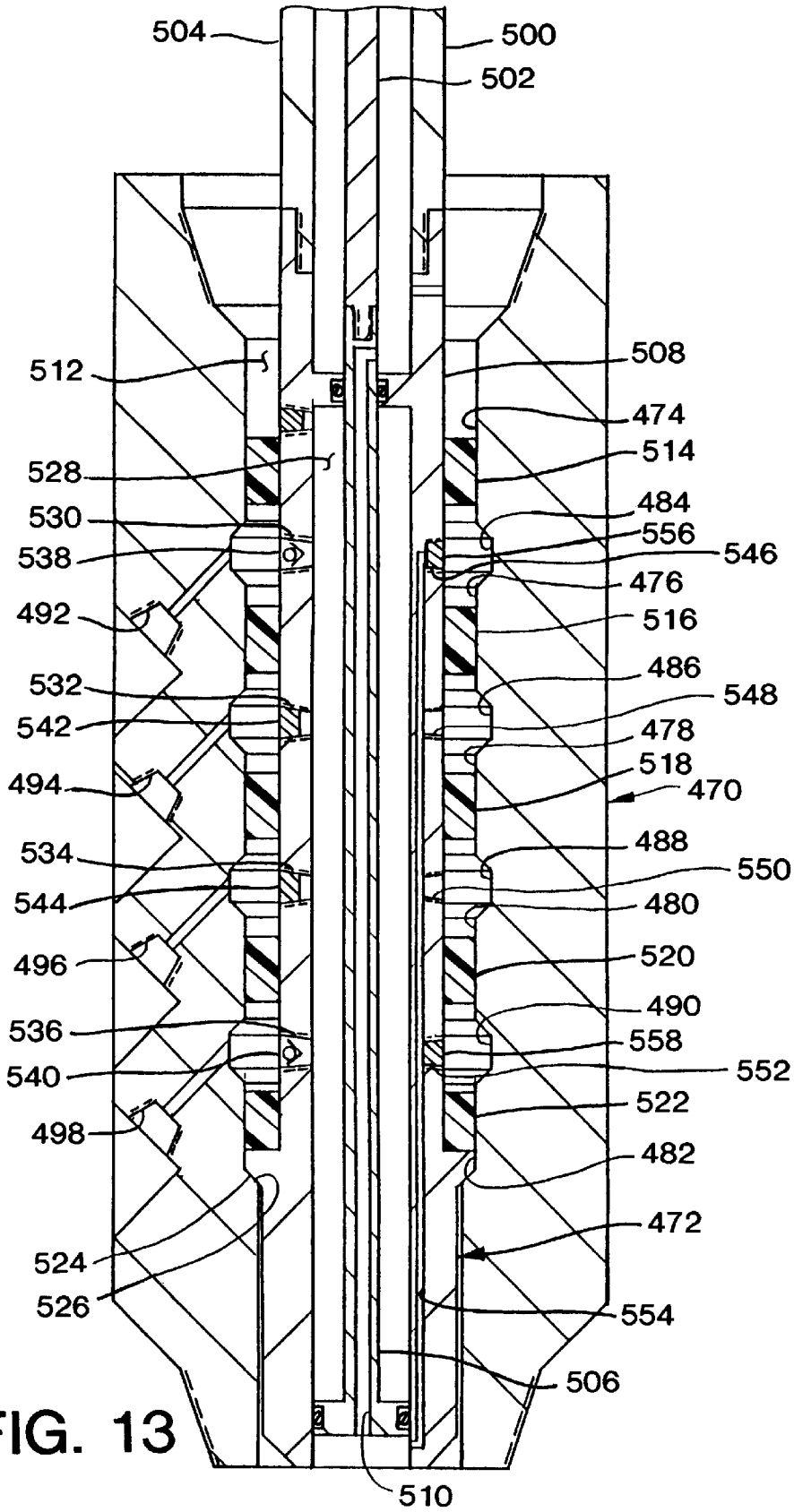
FIG. 13 is a cross-sectional view of an eighth hydraulic manifold and a eighth hydraulic path selector engaged therewith, the manifold and selector embodying principles of the present invention.

Referring additionally now to FIG. 13, a hydraulic manifold 470 and hydraulic path selector 472 embodying principles of the present invention are representatively and schematically illustrated. The manifold 470 is similar in most respects to previously described manifolds, in that a longitudinally spaced apart series of seal bores 474, 476, 478, 480, 482 are utilized to provide fluid isolation between annular recesses 484, 486, 488, 490 formed internally in the manifold, the recesses being in fluid communication with respective ports 492, 494, 496, 498 formed through a sidewall of the manifold. The selector 472, however, differs in several significant respects from previously described selectors.

The selector 472 is conveyed into the manifold 470 attached to an actuator 500 of the type well known to those skilled in the art. The conveyance may be wireline, slickline, electric line, coiled tubing, or any other type of conveyance. As representatively illustrated in FIG. 13, the actuator 500 is a linear actuator in which an inner mandrel 502 is upwardly displaced relative to an outer housing 504 when the actuator is operated. Suitable actuators which may be used for the actuator 500 include the DPU, an electromechanical actuator available from Halliburton Energy Services, Inc., and the Model 20 setting tool, a propellant driven actuator available from Baker Oil Tools, Inc. However, it is to be clearly understood that actuators other than the DPU and Model 20 setting tool, as well as other types of actuators, may be used for the actuator 500, without departing from the principles of the present invention.

A piston 506 is attached to the actuator mandrel 502, and an outer generally tubular housing 508 is attached to the actuator housing 504. Thus, when the mandrel 502 displaces upward relative to the housing 504, the piston 506 is thereby upwardly displaced relative to the housing 508.

An inner fluid passageway 510 formed through the piston 506 ensures that the piston is pressure balanced by providing fluid communication between upper and lower portions of an inner flow passage 512 formed through the manifold 470. The upper and lower portions of the passage 512 are separated by seals 514, 516, 518, 520, 522 carried externally on the selector 472 and sealingly engaged between the selector and corresponding ones of the seal bores 474, 476, 478, 480, 482.

The selector 472 is positioned within the manifold 470 by conveying it through a tubular string attached above the manifold and engaging an external shoulder 524 formed on the housing 508 with an internal no-go shoulder 526 formed in the manifold. Of course, it will be readily appreciated that other means of positioning the selector 472 relative to the manifold 470 may be utilized without departing from the principles of the present invention. For example, a conventional lock mandrel or other locating device may be attached to the selector 472 and engaged with a landing nipple, such as the nipple 70 in the methods 46, 48 described above, or keys, lugs or dogs may be provided on the selector for engagement with an internal profile formed in the manifold 470, such as the keys 124 and profile 108 depicted in FIG. 6, etc. Thus, any means of positioning the selector 472 relative to the manifold 470 may be utilized.

When the selector 472 has been appropriately positioned relative to the manifold 470, so that the seals 514, 516, 518, 520, 522 sealingly engage the seal bores 474, 476, 478, 480, 482, the actuator 500 is operated to displace the piston 506 upwardly as described above. Such upward displacement of the piston 506 relative to the housing 508 forces fluid contained in an annular chamber 528 formed between the piston and the housing to flow outwardly through selected ones of ports 530, 532, 534, 536 formed through a sidewall of the housing. A rupture disc or other type of pressure relief device may be provided for the chamber 528, to prevent excess buildup of pressure therein, to permit full displacement of the piston 506 if desired, etc.

As representatively illustrated in FIG. 13, ports 530 and 536 have been selected for flow of the fluid in the chamber 528 outwardly therethrough by installation of check valves 538, 540 therein, and ports 532, 534 have been excluded from flow of the fluid therethrough by installation of plugs 542, 544 therein. Thus, when the piston 506 is upwardly displaced relative to the housing 508, the fluid in the chamber 528 is flowed outwardly through the ports 538, 540, but not through the ports 532, 534.

Additionally, ports 546, 548, 550, 552 are formed externally in a sidewall of the housing 508, and are fluid communicable with a generally longitudinally extending fluid passage 554 formed in the sidewall and in fluid communication with the passage 512 below the lower seal 522. Each of the ports 546, 548, 550, 552 is positioned between a corresponding pair of the seals 514, 516, 518, 520, 522, so that each port is fluid communicable with one of the recesses 484, 486, 488, 490 and, thus, with a corresponding one of the ports 492, 494, 496, 498. As representatively illustrated in FIG. 13, plugs 556, 558 are installed in ports 546, 552, so that only ports 494, 496 are in fluid communication with the passage 554.

In a similar manner, each of ports 530, 532, 534, 536 is fluid communicable with a corresponding one of the manifold ports 492, 494, 496, 498. Since the plugs 542, 544 are installed in the ports 532, 534, fluid from the chamber 528 may only be flowed outwardly through manifold ports 492, 498. Thus, it will be readily appreciated that, if the manifold ports 492, 494 are interconnected via hydraulic paths to ports 24, 26, respectively, of the tool 10, and the manifold ports 496, 498 are interconnected via hydraulic paths to ports 24, 26, respectively, of another tool 10, one of the tools 10 may be closed, while the other of the tools is opened, when the piston 506 is displaced upwardly, thereby discharging the fluid in the chamber 528 outwardly through the ports 492, 498, and permitting return of fluid from the tools via manifold ports 548, 550 to the passage 512 below the lower seal 522.

A person skilled in the art, upon a careful consideration of the above descriptions of the embodiments provided herein would find it apparent to make modifications, additions, deletions, substitutions, and other changes to the embodiments, and these changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of servicing a well, the method comprising the steps of:

interconnecting at least one hydraulic manifold to at least first and second hydraulically operable tools in a tubular string, the manifold being connected to the tools via at least one hydraulic path;

installing the tubular string in the well, the installing step including positioning the first and second tools in the well for flow of fluids therethrough between the tubular string and respective first and second zones intersected by the well, and setting a packer in the well between the first and second tools;

conveying a hydraulic path selector into the tubular string;

engaging the selector with the manifold; and selecting at least one of the hydraulic paths with the selector, thereby selecting one of the first and second tools for adjustment of a rate of fluid flow therethrough.

2. The method according to claim 1, wherein in the conveying step, the selector is preconfigured to select a desired at least one of the hydraulic paths, the selector thereby automatically selecting the desired at least one of the hydraulic paths upon engagement with the manifold.

3. The method according to claim 1, wherein in the interconnecting step, the manifold is interconnected to first and second tools via respective first and second hydraulic paths, and wherein the selecting step further comprises permitting fluid communication between a fluid power source and the first hydraulic path, while preventing fluid communication between the fluid power source and the second hydraulic path.

4. The method according to claim 1, further comprising the step of operating at least one of the tools by applying fluid pressure to the tubular string.

5. The method according to claim 1, further comprising the step of operating at least one of the tools by discharging fluid from the selector into the selected hydraulic path.

6. A method of servicing a well, the method comprising the steps of:

interconnecting multiple hydraulically operable tools to a hydraulic manifold via multiple hydraulic paths, a first set of at least one of the hydraulic paths being interconnected between the manifold and a first one of the tools and a second set of at least one of the hydraulic paths being interconnected between the manifold and a second one of the tools, and the first path set including first and second hydraulic paths for operation of the first tool; and engaging a hydraulic path selector with the manifold, thereby selecting at least one of the first and second hydraulic path sets for operation of a corresponding at least one of the first and second tools and providing fluid communication between the first path and the tubular string.

7. The method according to claim 6, wherein in the engaging step, the selector is conveyed internally through a tubular string including the manifold and first and second tools.

8. The method according to claim 6, wherein the engaging step further comprises providing fluid communication between the first hydraulic path and a fluid power source.

9. The method according to claim 6, wherein the engaging step further comprises providing fluid communication between the first path and the tubular string above the manifold, and providing fluid communication between the second path and the tubular string below the manifold.

10. The method according to claim 6, further comprising the step of operating the selected at least one of the first and second tools by discharging fluid from the selector into the manifold.

11. The method according to claim 6, wherein the engaging step further comprises conveying the selector into the well suspended by a line.

12. A well system, comprising:

a tubular string including a hydraulically operable flow control device and at least one hydraulic manifold, the manifold being interconnected via only one hydraulic path to the flow control device for operation of the flow control device, a series of fluid pressures applied to the path causing the flow control device to successively increase and decrease a rate of fluid flow therethrough; and a hydraulic path selector engaged with the manifold, the selector selecting the flow control device for operation thereof.

13. The well system according to claim 12, wherein the selector permits fluid communication between a first hydraulic path and the tubular string above the manifold, and the selector permits fluid communication between a second hydraulic path and the tubular string below the manifold.

14. The well system according to claim 12, wherein the selector permits fluid communication between the tubular string and a first hydraulic path, and the selector prevents fluid communication between the tubular string and a second hydraulic path.

15. The well system according to claim 12, wherein the selector permits fluid communication between the hydraulic path and a fluid power source.

16. The well system according to claim 12, wherein the tubular string includes at least two of the hydraulically operable flow control devices, the manifold being interconnected to each of the flow control devices, and the selector selecting both of the flow control devices for concurrent operation of the flow control devices.

17. A well system, comprising:

a hydraulic manifold interconnected to at least first and second hydraulically operable tools via at least first and second respective sets of at least one hydraulic path per set; and a hydraulic path selector engaged within the manifold, the selector selecting the first hydraulic path set and thereby permitting fluid communication between a fluid power source and the first tool for operation thereof, while preventing fluid communication between the fluid power source and the second tool and precluding operation of the second tool, and wherein the fluid power source is a tubular string in which the manifold and first and second tools are interconnected.

18. The well system according to claim 17, wherein the selector permits fluid communication between the fluid power source and a first path of the first path set, and prevents fluid communication between the fluid power source and a second path of the first path set.

19. The well system according to claim 17, wherein the selector includes a spaced apart series of seals, the seals being sealingly engaged within the manifold between corresponding pairs of the hydraulic paths in the manifold.

20. The well system according to claim 17, wherein the selector includes multiple fluid passageways therein, and wherein the first hydraulic path set is selected by blocking selected ones of the passageways.

* * * * *